United States Patent [19]

Berkers

[11] 4,383,461

[45] May 17, 1983

[54] CHORD PERFORMING APPARATUS FOR AN ELECTRONIC ORGAN

[76] Inventor: Wilhelmus A. J. Berkers, 1 Harmoniestraat, 5751 SH Deurne, Netherlands

[21] Appl. No.: 134,893

[22] Filed: Mar. 28, 1980

[30] Foreign Application Priority Data

Apr. 2, 1979 [NL] Netherlands ..... 7902569

[51] Int. Cl.[3] ..... G10F 1/00

[52] U.S. Cl. ..... 84/1.03; 84/DIG. 12; 84/DIG. 22; 84/1.24

[58] Field of Search ..... 84/1.03, DIG. 12, DIG. 22, 84/1.24

[56] References Cited

U.S. PATENT DOCUMENTS 3,878,750 4/1975 Kapps ..... 84/1.03
3,889,568 6/1975 Amaya ..... 84/1.03
4,065,993 1/1978 Hirose ..... 84/DIG. 22
4,129,055 12/1978 Whittington et al. ..... 84/DIG. 22
4,147,083 4/1979 Woron et al. ..... 84/1.03

*Primary Examiner*—J. V. Truhe
*Assistant Examiner*—Forester W. Isen
*Attorney, Agent, or Firm*—Silverman, Cass & Singer, Ltd.

[57] ABSTRACT

A chord performing apparatus for an electronic organ with a chord-former, comprises control inputs for control signals defining the chord tone, and control inputs for control signals defining the chord type and control units which can be preset in accordance with a pattern of chord tones and chord types to be played and outputs which are scanned and controlled in the rhythm of the melody for performing the same function as the switch elements, connected with the control inputs of the chord-former.

14 Claims, 25 Drawing Figures

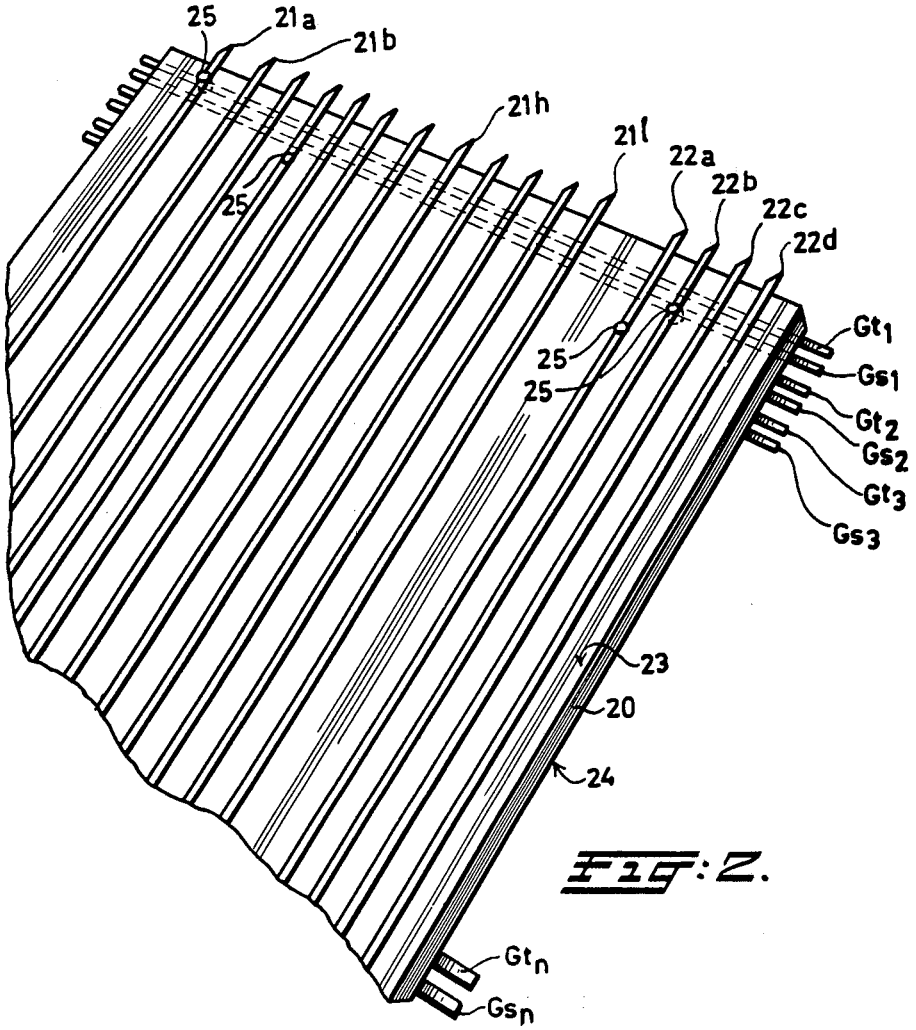
Fig: 2.
Fig: 3a.
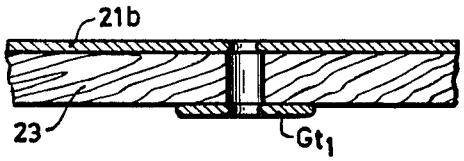
Fig: 3c.
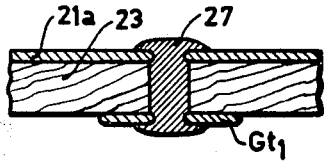
Fig: 3b.
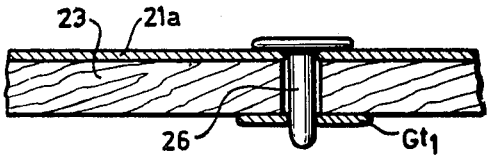

CHORD PERFORMING APPARATUS FOR AN ELECTRONIC ORGAN

BACKGROUND OF THE INVENTION

1. Field of the Invention

The present invention relates to a chord performing apparatus for an electronic organ with a chord-former, the latter being provided with one or more control inputs to which, via first switch elements control signals for defining the chord tone may be supplied and with one or more second control inputs to which, via second switch elements control signals for defining the chord type may be supplied, with a set of first and second presettable control units which, prior to the beginning of the playing, are set in accordance with a pattern of chord tones and chord types corresponding to the times or parts thereof of the piece of music to be played and in which the tones and chord types are presented in the rhythm of the melody, in a desired sequence, during the playing.

2. Description of the Prior Art

Electronic musical instruments with a chord-former, such as an electronic organ or an electronic accordion, have been used in the art. An example hereof is the Cosmovox organ, type F50. Over and above the simple organs, such organs have the advantage that by touching keys in the undermanual a complete chord is produced; the tone of this chord is defined by the key touched and the chordtype (major, minor, seventh degree, dim) is defined by a switch to be operated separately.

Although playing a similar organ gives the beginner earlier satisfaction than playing a normal organ—one is released of playing the complete chords, using several fingers of one hand, which is so difficult, particularly at the beginning—it has been found in practice nevertheless that also this simplified playing is experienced by many as being too complicated, because particularly the co-ordination of both hands, the playing of two manuals at the same time and the touching of the right keys demand prolonged exercise. As a result thereof, the beginner does not derive that pleasure from the instrument he had imagined and often breaks off the study in an early stage.

U.S. Pat. No. 3,889,568 (PIONEER) teaches an automatic chord performance apparatus for an electronic chord organ with a memory for selectively storing a limited number of typical chord patterns, said memory being combined with encoding and decoding means and controlling a chord selecting circuit with a tone generating circuit. Contrarily thereto the present invention proposes to use the existing chord generating circuit which is present in any automatic chord ogran and offers the advantage of easier programming, a wider choice with many variations, and the possibility to adapt the device to any kind of organ; it can be included at the factory but it is also possible to add it to already existing organs

SUMMARY OF THE INVENTION

With a view of the foregoing factors and conditions of the prior art the present invention is based on the principle that by making use of the possibilities presented by a modern electronic musical instrument, an even further simplification of the playing may be obtained if in a certain rhythm the chords belonging to the bars of a certain melody may be produced by the organ itself, while then the player needs only play the melody. The invention provides a control unit for an electronic musical instrument which makes this possible.

This object is obtained in that the outputs of the first and second control units, which are scanned and controlled in the rhythm of the melody and which can perform the same function as the switch elements are connected with the first and second control inputs of the chord-former in such a manner that the set tones and chord types are generated via this chord former in this prefixed sequence.

The control units are preset in accordance with the desired chords and kinds of chords; by scanning and controlling them in the rhythm of the melody to be played they control the chord-former, the result being that certain chords are presented in the rhythm of the melody. The player needs than only play the melody.

The rhythm may be defined by a separate clock-oscillator, but preferably, more particularly in the case of an organ with rhythm unit, the control rhythm for the scanning will be derived from this rhythm unit.

The chord-former known as such has a number of control inputs for defining the various chord-tones and a number of control inputs for defining the various chord types to which, via switch contacts provided in the musical instrument, for instance keys, a suitable control voltage (earth potential or a potential different from it) is supplied for determining the chord-tone and the type. Now, according to the present invention, the sets of control units are preferably provided with an input and with for each function mutually parallel outputs which are connected with the first resp. the second control inputs of the chord-former, while the inputs are connected consecutively to a suitable control voltage in the rhythm of the melody.

The control units may be constructed in many different manners. A purely electromechanical embodiment comprises sets of multi-position switches, one set for each bar, of which the corresponding outputs are connected mutually and with the respective control inputs and of which the inputs are consecutively scanned and connected with a source of control voltage. These sets of multi-position switches may be fitted to a fixed panel, the player having to set the two switches of a set for each bar in accordance with the desired chord and the desired chord-type.

The control units, however, may also be made up of one or more sets of conductor matrixes, arranged on a bearer either or not interchangeable, with intersecting input guides and output conductors between which connections may be made on the crossings. The connections may be permanent or e.g. be brought about by connecting pins on the crossings.

The embodiment of the present invention with permanent connections is intended to be marketed with the music sheet on which the melody to be played is recorded; of course, this bearer, which may be made by using the technology of printed circuits, should be easily interchangeable, which with the modern connection plugs used with bearers with printed circuits, can be realized in a simple manner.

The embodiments described in the foregoing form immediately the necessary electric connections for the transmission of control voltage to the inputs of the chord-former. However, interesting possibilities arise when the control units are made up of a programmable information bearer processed by a reading device. This bearer may be both an bearer to be optically read-out or a punchcard.

Of course, the bearer may be moved through the reading device in the rhythm of the melody to be played using the signals generated thereby for controlling the inputs of the chord-former. Preferably, however, use will be made of a readout device for reading the information bearer, the outputs of which being connected with a memory in which the information arranged on the bearer can be recorded and from which this information may be readout for controlling the organ in the rhythm of the melody to be played. Before the playing of the piece of music is commenced with, the bearer may be readout rapidly and the information present therein may be stored in the memory; this memory is then read-out in the rhythm of the melody to be played and the signals obtained thereby control the chord-former. Particularly the known optical bearer in which the player has to fill up (blacken) the spaces corresponding with the various chord tones and chordtypes has the advantage of being cheap, of occupying little space and of leaving space for arranging certain instructions thereon. So it is possible, for instance, to mark the series of information places corresponding with chord tones and chordtypes in accordance with the arrangement of the keys in the keyboard, the known stave script or the Klavarskribo script.

The information bearer may be a programmable bearer with magnetic parts or with electrically conductible parts. The series of positions corresponding with the inputs of the chord-former may be indicated thereon in binarily coded form, in which case a decoding device controlled by the information readout must be used, this device converting this binary information into information to be supplied direct to the 12 inputs of the chord-former and to be processed by the latter. These measures have the advantage to decrease the width of the information bearer; the twelve chord tones may be indicated with only four binary positions and the five chordtypes with two binary positions. The programming, however, is somewhat more cumbrous, as the user has first to code the number of the chord tone and chordtype in binary form and to arrange this code on the card, so that this embodiment does not lend itself to arranging a scheme of a key-board or of stave script or Klavarskribo script on the information bearer.

This coding in binary form may also be used with the programcard with selector switches mentioned above in which case the coding thumbwheel switches are used.

There exists the possibility of extending. The installation may be extended with control units for controlling the parts of the organ which generate the organ tones for performing a melody, which is very well possible particularly in the case of a binarily coded program card—on which much information may be arranged in a small compass and the processing thereof by means of a micro-processor which may be adapted to many embodiments. In this manner there arises the possibility of four-handed playing or, before starting an exercise, the pupil who uses a preset information bearer, can make the melody of the piece of music sound for himself. This possibility is particularly interesting for demonstration and teaching purposes.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF THE DRAWINGS

FIG. 2 is a schematic example of a program board used in a certain embodiment of the present invention.

FIGS. 3*a*, 3*b* and 3*c* show the manner in which connections may be made in such a board.

FIG. 18 is a logical diagram belonging to FIG. 16.

DESCRIPTION OF PREFERRED EMBODIMENT

In order to best understand the present invention a description of a preferred embodiment thereof is provided accompanied by drawings. Initially referring to FIG. 1 a very simplified diagram is shown with reference to which the inventive idea will be explained.

Figure 1:
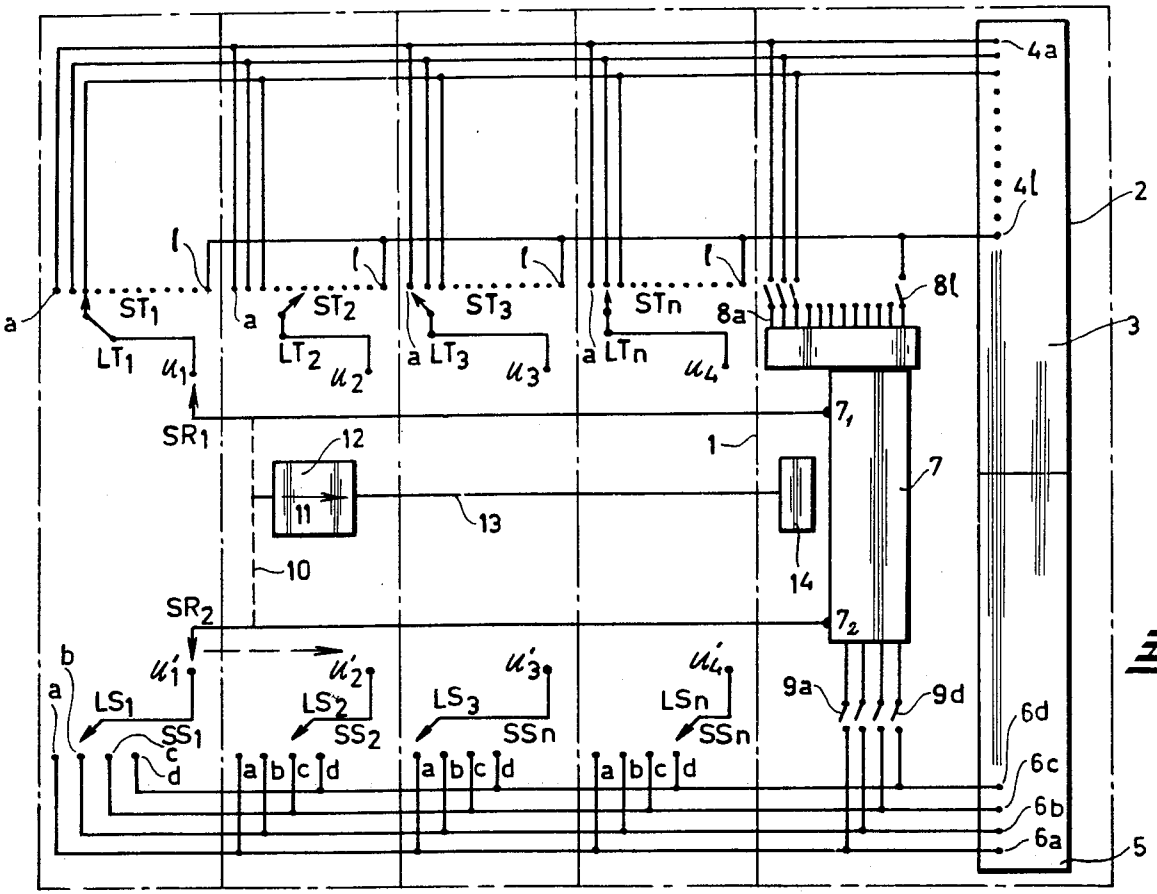
FIG. 1 is a very simplified scheme with reference to which the present invention will be explained.

The parts drawn in FIG. 1 to the right of the dot and dash line 1 are present in a modern electronic organ. They comprise the, of course schematically indicated, chord former 2 with the portion 3 which, by supplying a suitable voltage to one of the inputs 4*a*–4*l* define which chord tone the chord former will produce, and part 5 which, by supplying a suitable control voltage to the inputs 6*a*–6*d*, defines which chord type (major, minor, seventh, dim) of the respective defined chord tone is generated. Furthermore, the figure shows schematically indicated by the rectangle 7, a suitable source of control voltage for the chord-former 2. By means of the switches 8*a*–8*l*, which in fact are contacts of keys of one complete octave of the undermanual, a suitable control voltage (which may, of course, also be earth potential) may be supplied to the inputs 4*a*–4*l* of part 3 which defines the chord tone; via switches 9*a*–9*d* a suitable voltage may be supplied to inputs 6a–6d of part 5 which defines the chord type.

According to the present invention, extra connections, to be made with the available switches 8a–8l respectively 9a–9d, are formed before the performance of the piece of music and are activated in the rhythm of the melody to be played, for the consecutive supply of suitable control voltages to part 3 which defines the chord tone and part 5 which defines the chord type. A smilar connection should be activated for each bar or, in the case of quadruple time, for each two counts of a similar bar.

FIG. 1 shows schematically how this is done with n twelve-position switches (in accordance with the twelve chord tones) ST1 . . . STn and n four-position switches SS1 . . . SSn. Of the twelve-position switches ST1 . . . STN all the corresponding outputs, indicated with the addition a . . . l, ST1*a* . . . ST1*l*, ST2*a* . . . ST2*l*, ST1*na* . . . STnl are mutually interconnected and also connected with the inputs 4a . . . 4l of the chord tone definer 3, while of the switches SS1 . . . SSn, in a similar manner, the outputs SS1*a* . . . SS1*d*, SSna . . . SSnd are mutually interconnected and are connected with the inputs 6a . . . 6d of the chord-kind definer 5. In the rhythm of the melody to be played, the sets of switches ST1, SS1-SS2, SS2-STn, SSn are now consecutively scanned by the respective movable contacts of the scanning switches SR1 and SR2; for this purpose, of each switch ST1 . . . STn respectively SS1 . . . SSn the respective movable contact LT1 . . . LTn, LS1 . . . LSn is connected with outputs U1 . . . Un on the one hand and U1' . . . Un' on the other hand of two scanning switches SR1 respectively SR2. The input of switch SR1 is connected with the output $7_1$ of the source of control voltage 7 which supplies control voltage for the inputs 4a . . . 4l, while the input of switch SR2 is connected with output $7_2$ of this source of control voltage 7 which supplies control voltage for the inputs 6a . . . 6d. The movable contacts of switches SR1, SR2 are intercoupled as schematically indicated with the dotted lines 10; they are driven jointly, as symbolized by the arrow 11, by the block 12 which represents the control of the switches SR1, SR2 which, via connection 13 is controlled from the rhythm unit 14 in the organ and which, in this rhythm, sequentially moves the switches SR1, SR2 step by step.

Before the beginning of the playing, each switch ST1 . . . STn on the one hand and SS1 . . . SSn on the other hand is set in a certain position, always according to the chord to be generated in a certain bar or half bar. Subsequently the outputs U1 . . . Un, respectively U1' . . . Un are scanned by the two switches SR1, SR2 in the rhythm defined by the rhythm unit 14 which controls the movement 12 of the switches SR1, SR2 so that in this same rhythm a suitable control voltage is supplied at the inputs 4a . . . 4l on the one hand and 6a . . . 6d on the other hand for each bar or half bar, resulting in the production of a chord of which the tone is defined by input 4a . . . 4l 6a . . . 6d respectively to which at that moment a voltage is supplied.

In a simple embodiment, the switches ST1 . . . STn, respectively SS1 . . . SSn might be rotary switches arranged on a panel and the switches SR1, SR2 might be stepswitches, for instance as used in telephone circuits to be driven via drive 12.

It is clear, however, that in a practical embodiment preference will be given to a construction in which more use is made of modern electronic circuits and components. So, for instance, the switches ST1 . . . STn, respectively SS1 . . . SSn might be replaced by panels with a fixed circuit between which connections, either or not permanent, are made.

FIG. 2 shows schematically an example of such an embodiment and FIG. 3 shows a cross-section thereof on an enlarged scale illustrating how connections may be made.

Referring now to the embodiment of FIG. 2 a set of twelve conductors 21a . . . 21l and a set of four conductors 22a . . . 22d are arranged on the panel 20. These conductors are located on the upper face 23 of the panel 20. On the lower face 24 of the panel 20 there are arranged a number of sets of two conductors; each set comprises a first conductor GT1 and a second conductor GS1; so there are n sets of which the final set is indicated by GTn, GSn. The functions performed by the adjustable switches ST1 . . . STn on the one hand and SS1 . . . SSn on the other hand have now to be performed by connections to be made selectively between each time one of the conductors 21a . . . 21l on the one hand and a conductor GT1 . . . GTn, by which always the tone of the chord to be produced is defined with a connection between one of the conductors 22a . . . 22l and the conductors GS1 . . . GSn by which the kind of chord is defined. The conductors 21a . . . 21l are connected with the inputs 4a . . . 4l which define the chord tone and the conductors 22a . . . 22d are connected with the inputs 6a . . . 6d which define the chord-type; the sets of conductors GT1, GS1 . . . GTn, GSn are again connected, via suitable dial switches, with the outputs $7_1$, $7_2$ of the source of control voltage 7, in the rhythm of the melody to be played.

FIG. 2 further indicates how the conductor 21a is connected with the conductor GT1 which is symbolically indicated by a little circle 25 while the conductor 22b is connected with the conductor GS1, so that by the scanning of the conductors GT1, GS1 by the switches SR1, SR2 respectively the input of the definer of the chord tone and the input of the definer of the chord type now receives voltage for the next bar the conductor 21d is connected with the conductor GT2 and the conductor 22a with the conductor GS2, so that in the subsequent bar the input 4d and the input 6a receive control voltage. FIGS. 3a to 3c show in cross-section on a much enlarged scale, the situation in which there is no connection (FIG. 3a), a connection is formed by means of a plug pin (FIG. 3b) and a connection is made by meamns of a soldered connection (FIG. 3c).

Specifically referring now to FIG. 3a the panel 23 comprises conductor 21b and the conductor GT1 between which there is no connection. Referring now to FIG. 3b the situation is shown in which there is a connection in the case between the conductor 21a and the conductor GT1 such as indicated by a circle 25 to which connection is formed by means of a plug pin 26. Finally referring to FIG. 3c the situation is shown in which a permanent connection is formed, namely between the conductor 21a and the conductor GT1 by means of the soldermass 27. It is clear that, with this embodiment, for each melody to be played a separate panel must be used.

The connections with the conductors on the panels can be easily made by providing the panels with the known connectors, not shown in the figure, which may be arranged along two longitudinal edges of the panel 23.

Instead of a panel of the form illustrated, use may be made of a suitable form of a known and commercial matrix-connection board with which, as is known per se connections between crossing sets of conductors can be realized.

Figure 4:
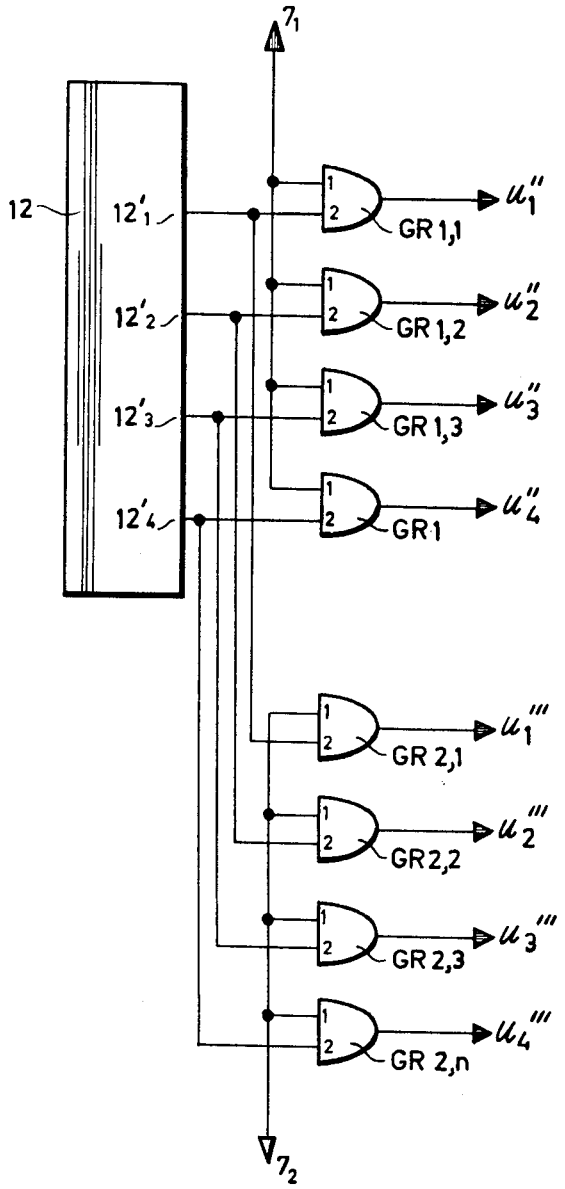
FIG. 4 is a set of logical AND-gated which may be used to replace switches in the scheme of FIG. 1.

Instead of the scanning switches SR1, SR2, use may be made also of gates to be made conducting consecutively in the rhythm of the melody to be played, as referred to schematically in FIG. 4. The switch SR1 is replaced by the range of gates $GR1_1 \ldots GR1_n$ with the outputs U1'' . . . UN'', while the switch SR2 is replaced by the range of gates $GR2_1 \ldots GR2_n$ with the outputs U1''' . . . UN'''. Of the gates $GR1_1 \ldots GR1_n$ the first inputs are connected with the output $7_1$ of the source of control voltage 7, while of the gated $GR2_1 \ldots GR2_n$ the inputs are connected with the output $7_2$ of this source of control voltage 7. Of the gate $GR1_1$ the input 2 is connected with the input 2 of the gate $GR2_1$ and also connected with the control output 12'1 of the control circuit 12'; of the gate $GR1_2$ the input 2 is connected with the input 2 of the gate $GR2_2$ and with the control output 12'2 of the control circuit 12', while of the gate $GR1_n$ the input is connected with the input 2 of the gate $GR2_n$ and with the control output 12'*n* of the control circuit 12'.

Consecutively and in the rhythm of the melody, the outputs 12'1 . . . 12'*n* supply control voltage to two gates at a time; always one gate from the first set will be conducting at the same time as a gate from the second set, so that for instance the gate $GR1_3$ is at the same time conductive with the gate $GR2_3$. In this manner control voltage emanating from the source of control voltage 7 is consecutively supplied to the outputs U1 . . . Un respectively U1' . . . Un', these control voltages controlling the chord tone definer 3 the chord type definer 5, resp.

Figure 5A:
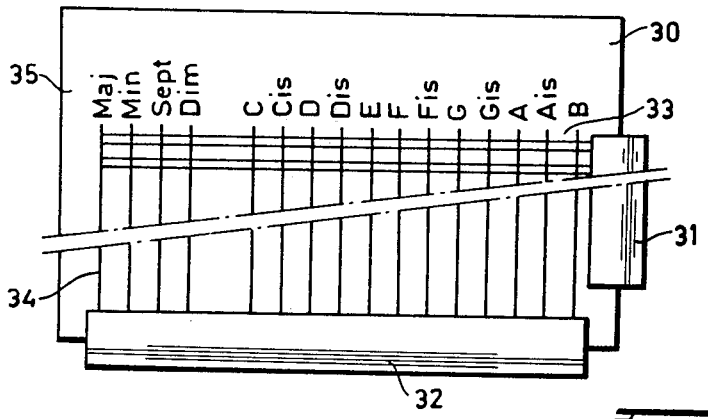
FIGS. 5*a* to 5*c* are schematic examples of program boards with the indications used thereon.
Figure 5B:
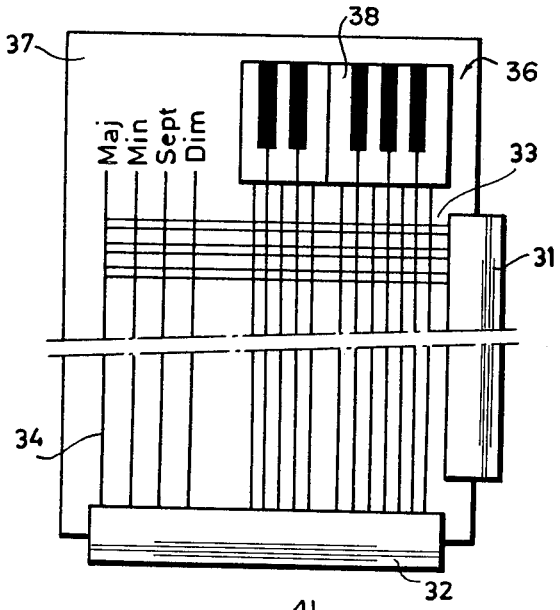
Figure 5C:
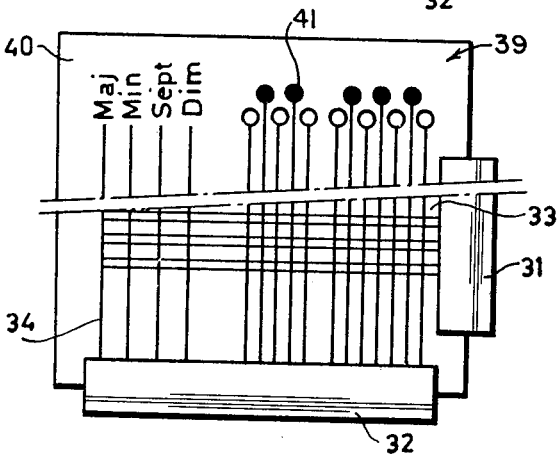

In FIGS. 5*a* to 5*c* embodiments are shown of a program board with indications thereon which are intended to simplify the programming.

FIG. 5*a* is a board 30 with connectors 31, 32 arranged along the two edges for respectively the horizontal conductors 33 and the vertical conductors 34, on which program board, on the upper edge 35, from left to right, first the four chord types and then the twelve chord tones are indicated.

FIGS. 5*b* and 5*c* are other embodiments in which corresponding parts are indicated by the same reference numbers; FIG. 5*b* shows a board 36 with, on the upper edge 37, from left to right, first again the indication of the chord type and then an illustration 38, showing part of the keyboard, by which is indicated direct with which chord-tone lines the keys correspond.

Finally, FIG. 5*c* is a board 39 with, along its upper edge 40, first the names of the chord types and then an illustration with reference number 41 of the keyboard in the known klavarskribo script.

By means of integrated circuits and modern miniature components, an embodiment based on the principle of FIG. 4 can be made very compactly. However, interesting possibilities turn up when microprocessor technologies are used in combination with modern optically readable program cards. Such a card may be programmed in a manner analogous to the embodiment with the bearer with printed circuit in which there are at least twelve plus four (sixteen) ranges of program positions, but it is also possible to define the twelve chord-tone positions in a binary code for which purpose five code positions will suffice, while the four chord types may be coded with two code positions. This results in a relatively narrow program card, but then the player has to convert the twelve, respectively the four positions, first into a binary code before filling in the code positions accordingly.

Actual practice has proved the average player to be capable of mastering such a conversion quickly by means of conversion tables. In fact, this requires a converter by means of which the digital code read after the reading of the respective positions, is converted again into the twelve plus four control values since, naturally twelve plus four inputs of the chord-former have to be controlled.

The principle of digital coding may also be applied to the above embodiments provided with adjustable switches in which case the adjustable switches may be the known thumbwheel switches which supply the digital code directly.

An embodiment based entirely on the technology of the micro-processors will be now described below.

Figure 6:
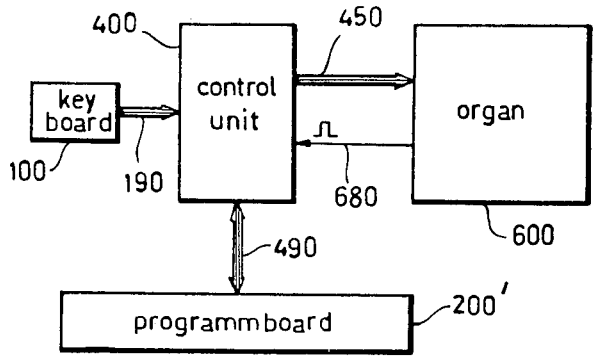
FIG. 6 is a schematic diagram of an embodiment according to the present invention.

In FIG. 6, the block 100 represents the combination of switches and/or keys by means of which, via bus 190, the player may pass commands to the control unit 400, so that the desired operations may be carried out. These operations are, for instance, starting the playing, stopping the playing, repeating of a part, etc.

The block 200' in FIG. 6 is analogue with the switchor program board described above, the latter with fixed circuit or programming pins. FIGS. 9, 10, 11, 15 and 16 show an optically readable program card with program positions to be filled in, a black space in these figures corresponds with a closed switch or with a programming pin which makes an electric connection between a line and a column. By means of unit 200' a range of chords is programmed, of which range the chords will later on have to be supplied to the electronic organ in sequence via the bus 450 in response to a command from the electronic organ on line 680. The explanation of the symbols used in FIGS. 9, 10, 11, 15 and 16 with reference to FIGS. 12, 13, 17 and 18 is not yet important and will be broached only with reference to FIGS. 7 and 8. For the present, can be said that a black, blank space respectively in the first five figures mentioned corresponds with a logical one, respectively, 0 in the other four figures mentioned.

After the block 200' has been programmed, the control (block 400) is started. The electronic organ generates a pulse at each first or third tone of a bar, which pulse is supplied to control unit 400 via line 680. Upon receipt of the pulse, the control unit 400 gives the electronic organ 600 the control signal for the right chord from the range of chords programmed in sequence with the block 200' for a preset time (touch) via the bus 450. The programmed words of the block 200' are then read column after column, a test being always carried out at an intersection either or not interconnected, between a column and the various ranges. Such a reading/scanning technology is known per se and there is no need to illustrate and explain it in further detail.

Figure 7:
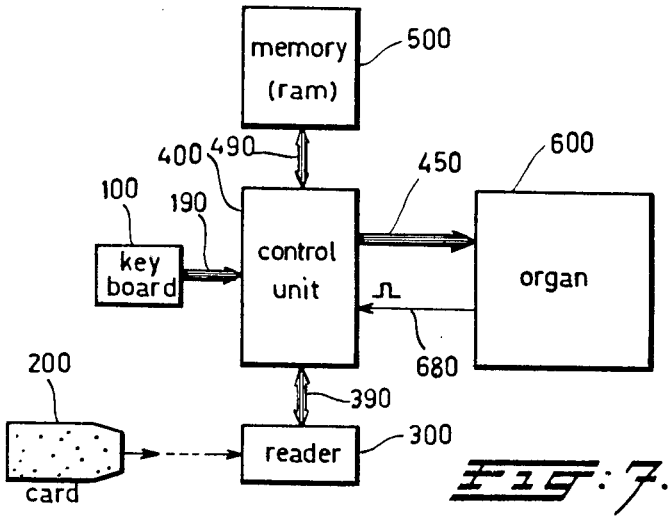
FIG. 7 is a schematic diagram of another embodiment according to the present invention.

In connection with costs the size of a switch board or program board 200' will generally be such that a song of an average length of time, i.e. an average number of bars, may be programmed. The result thereof is that a range of chords to be programmed cannot have an unlimited length. Also in connection with costs the use of a range or number of boards for long pieces of music is not an attractive solution. If such a board, for instance because of the price, is not removable and available in more than one unit, it is moreover necessary to program the one program board for each song to be played which is timeconsuming and, for instance, for organ lessons, undesirable. Making the program board 200' interchangeable with another similar board meets this drawback but, as stated, the costs of a number of boards may be prohibitive while the storage of the boards gives practical problems: measures should then be taken to ensure that no switches are operated unnoticed or that switches or programming pins are damaged. The solution of these problems lies in the use of inexpensive readable program cards and FIG. 7 shows the scheme of an embodiment according to the present invention which is based on the use of an inexpensive separate bearer for recording a range of chords of a song. For this purpose, program cards and punch tapes known per se, which are used, among others, for calculating machines, come into consideration. In order to enable a player to record personally a range of chords on indexable places of a card without bulky and/or expensive apparatus, be so-called striped cards are preferred of which FIGS. 9, 10, 11, 15 and 16 show some examples, or cards on which an electrically conducting layer may be applied an electrically conducting sticker or the lead of a lead-pencil on the card.

Block 500 in FIG. 7 is a randomly accessible reading/writing semiconducting memory (RAM). Such memories are relatively cheap and to be had in various embodiments and dimensions. The available individual memories or compositions thereof may have such dimensions that the ranges of chords of several songs can be stored therein. When using this possibility, this should be taken into account when programming the card, when loading the card information into the memory and when reading the memory for use by the organ. In order to ensure that when playing the organ and after the end of a song the chords of a following song will not be used unintentionally, for instance by a spontaneously improvised and performed prolongation of the finale, it is necessary that the beginning and the end of the individual ranges of chord are marked as such. Therefor, there should be a beginning and an end-symbol, while it is also possible to state the number of chords and derive therefrom at which moment the range of cords has been finished entirely. The marking of the beginning and the end of a range of chords is also useful if it is desired to exchange a range stored in the memory for a new range. Furthermore, the control unit 400 may be constructed in such a way that, by means of the beginning and end symbols, the contents of the memory may be arranged anew for optimum use of the capacity of the memory. If the number of individual ranges of chords/songs in the memory 500 is great, it is also preferred to number the songs. Preferably the number should then also be shown on the chord card. By keying a number which the player can read from the chord card later on or from his music sheet, it is possible to move quickly to the beginning of any range of chords/song in the memory 500.

An installation built up of individual components demands relatively many components, also in case the range of chords of one song is stored, so that the manufacture thereof is expensive. In connection with the control, such as for the identification of the beginning-/end symbols, the numerals of the song number and relative jumps in the memory, an installation in which several ranges of chords of a number of songs are stored requires even more components. In that case, the use of a so-called microprocessor is certainly to be preferred. The installation will then not only remain physically compact and inexpensive, but it will also very flexible with respect to later modifications. A similar embodiment will now be described in further detail.

Figure 12:
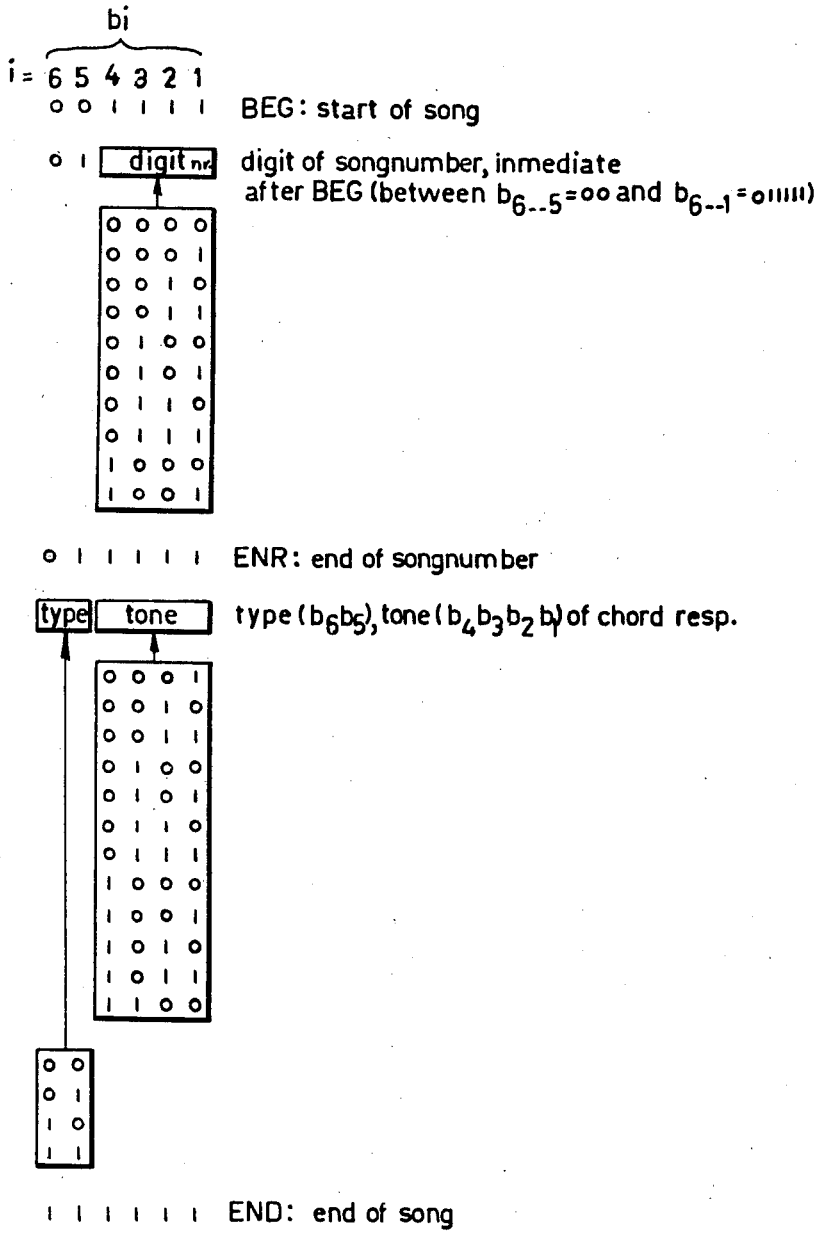
FIG. 12 is a logical diagram belonging to the embodiment of FIGS. 9 and 10 and refers to the storage in the memory of the embodiment of FIG. 7.

The number of types of chords to be used is four, namely major, minor, seventh, dim (although still other kinds of chords are not precluded), and the number of settings of the chords to be applied is twelve, namely C, C sharp, D, D sharp, E, F, F sharp, G, G sharp, A, A sharp and B. Then four times twelve makes fortyeight combinations are possible. By representing each combination in the form of a binary codeword, 6 bitwords suffice. Without coding the minimum word-width would be $4+12=16$ bit; this is also the number of ranges used in the program boards described above. The numbers of kinds and settings of chords to be used are such that an easily readable coding may be obtained. FIG. 12 shows an example of a possible coding. The type of chord in this example is represented by 2 bits ($b_5$ and $b_6$), while the setting is represented by the four remaining bits ($b_1$ to $b_4$). Thus the code for the setting is the same for each of the types of chord which allows easy reading and quick programming and control of a program chord. The combination $b_1$ to $b_6=000000$ may deliberately be taken up in the range of chords to be programmed because they are not taken up from the card into the memory. This is advantageous if it is desired to erase one or more chords programmed too many, or if it is desired to obtain a separation easily to be interpreted visually on a card. The remaining 15 combinations of the code according to FIG. 12 may be used for introducing additional information on the card, e.g. with regard to the beginning and the end of a range of chords/songs and with regard to the song number. For an easy visual interpretation, preferably the combinations given in FIG. 12 are used in the present installation. The combination ENR is used for programming a song of any length. With a view to the simple programming and reading by the player, the song number should be represented preferably in bed-form (binary coded decimal) with the most significant cypher in front. In order not to mix up an 0 in the song number with the codeword with the binary value 0, $b_5$ and/or $b_6$ of a cypher of the song number should be given the logical value "1".

The cards may have any length, that is they may comprise any number of codewords, because the range of chords and additional information of a song may be spread on several cards and several cards may consecutively be recorded in the memory. For the reading by the reading unit 300, a synchronisation track 201 may be made on the card (see FIG. 11). This, is not essential, however, since a relevant codeword has at least one logical "1", furthermore by using a narrow program card (FIG. 9) a good guiding of the card is possible and the signals emanating from the scanners may be integrated before a decision is taken as to which of the possible codewords is actually read. However, in case a broad card is used, for instance as shown in FIG. 10, such a synchronization track 201 is advisable. FIG. 11 shows a possible solution for a program card 200 if the information concerning the chords is not coded. Such a card is more particularly suitable for those players who perfer it for reasons of simplicity of the programming, speed of the programming and the number of cards to be programmed and who are less interested in the size of the card and the possible number of chords to be programmed on the card. In this connection, it is preferable to represent the song number in decimal form. The control symbols shown on the card according to FIG. 11 have the signification indicated in FIG. 13.

It is to be observed that the card according to FIG. 11 presents the possibility of indicating the chord tones by means of symbols of the organ keys indicated on the card, or according to the klavarskribo system or the customary music notation, as explained with reference to FIG. 5 which is a convenience especially for the beginner.

Figure 9:
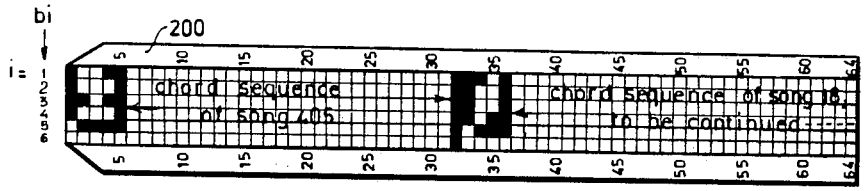
FIGS. 9, 10 and 11 are illustrations of program cards for use with the embodiment according to FIG. 7.
Figure 10:
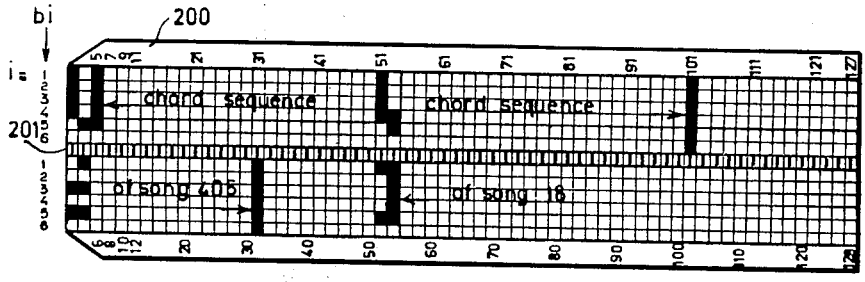
Figure 11:
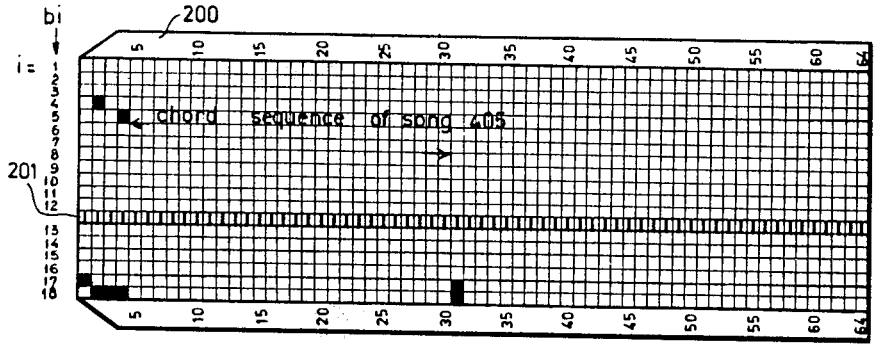

Because preferably a microprocessor is used, the control program can be made suitable in a simple manner for reading of information of the cards according to FIGS. 9 to 11 mentioned as examples. By means of a selector switch or a marking by means of the wiring, the control program can be given information as to which type of card 200 c.q. card reader 300 is used. By making the card readers 300 exchangeable, the wishes of a potential user can be met to a high degree.

Figure 14:
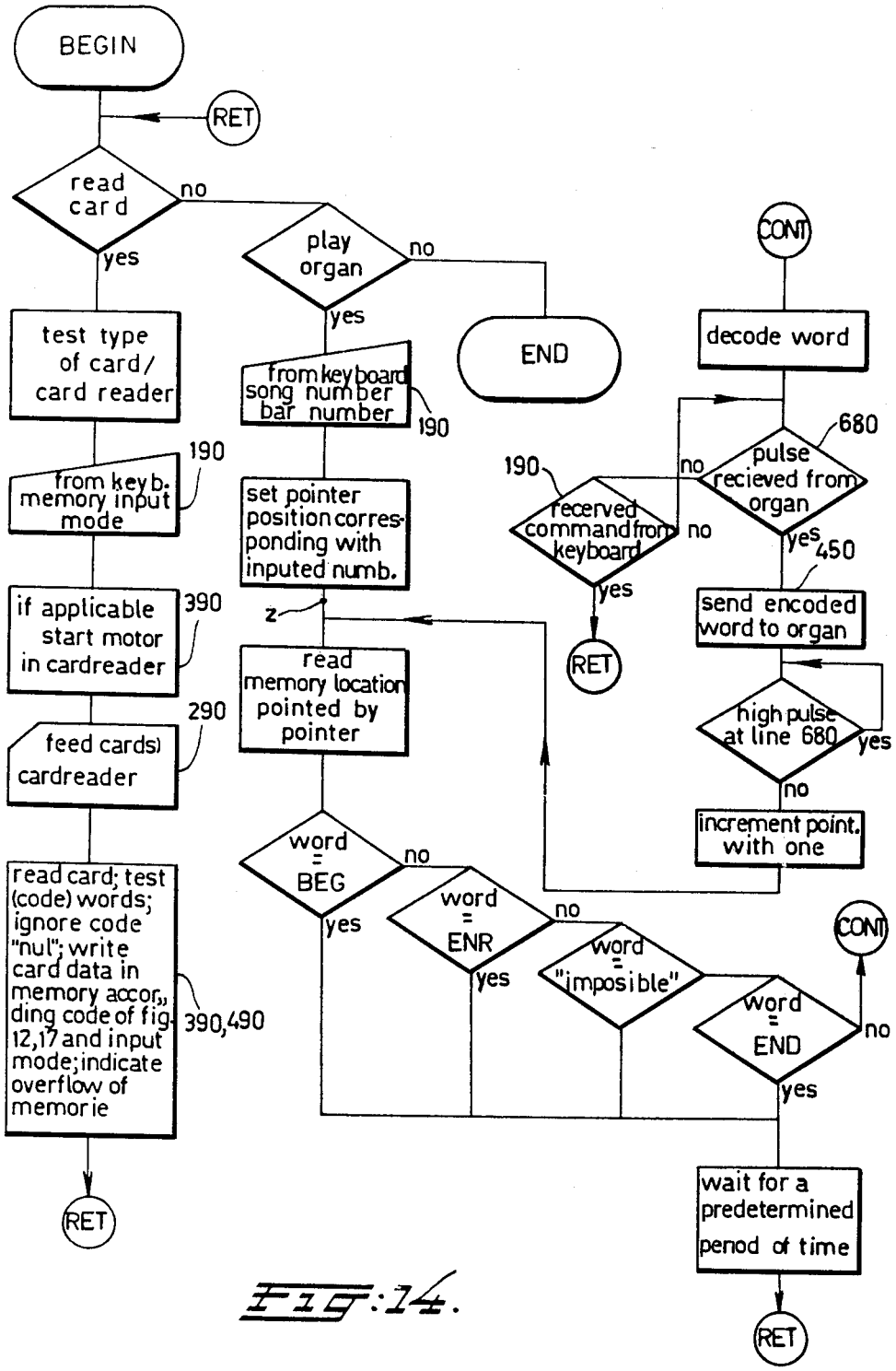
FIG. 14 is a flow chart which explains the operation of the embodiment of FIG. 7.

The following is an explanation of the embodiment according to FIG. 7. This is not based upon a conventional component arrangement but referenced on a so-called flow chart which is shown in FIG. 14. By means of the many commercial components, many embodiments may be made which only differ in their physical apearance.

In the flow chart according to FIG. 14, only one block is shown as a subroutine; other blocks, combinations or parts of blocks in this diagram may also be programmed as subroutines.

In the flow chart according to FIG. 14, only one block is shown as a subroutine; other blocks, combinations or parts of blocks in this diagram may also be programmed as subroutines.

The current diagram according to FIG. 14 comprises two important portions, namely a portion which is connected with the recording of a program card and a portion for reading out the memory during the playing of the electronic organ. For this reading there are two possibilities:

(a) first erase the entire memory and then record one or more songs;

(b) exchange one or more songs recorded in the memory for one or more new songs and maintain the rest. With the indications in FIG. 14 a relation is established with the signal buses in FIG. 7.

If by means of the control panel it is indicated whether a card has to be red, a test is carried out with regard to the kind of the card 200 used or the card reader 300. Then the drive motor in the reading unit 300 is started to move the card 200 along a scanner in the unit 300. Transport of the card by handdrive is also possible. Subsequently or before, the user should indicate in what manner the input into the memory 500 should take place. This is dependent on the information whether the card 200 refers to the first song to be introduced, on the information whether the song is a song to be added, or on the information whether the song should be exchanged for another song already stored in the memory 500. More particularly, so far as the latter aspect is concerned, the program is such that optimal use is made of the memory 500 and that, if needs be, a new arrangement of the memory information is carried out. Moreover, with a view to optimal use of the memory 500, the card information is put into the memory in a coded form, namely according to FIG. 12. A codeword with the binary 0 value recorded on the card 200 is not read in the memory.

After the END symbol on the card has been read, or a suitable instruction has been given by means of the keyboard 100 via bus 190, the motor in the reading unit 300 is stopped and the reading procedure is diverted from.

If the organ 600 is going to be played and instructions thereto are given to the control unit 400 from the panel 100 via bus 190, the memory can be read for supplying the programmed cords to the electronic organ 600. For this purpose, the song number and the bar number in that song should be recorded. If a number of songs is to be played consecutively, the respective numbers may be put into and stored in a register, for instance a portion of memory 500, for being reread in sequence. If, with respect to the contents of the memory, "impossible" numbers are indicated, this is signalled and new numbers have to be given. At the beginning of the playing, an indicator is put into the position which belongs to the memory location with the right numbers referred to above. If the word indicated by the indicator refers to the END symbol, a prefixed waiting time is taken into consideration before a range of chords of a song can be read from the memory. After termination of a song this waiting time is used for continuing automatically with a following song, the player being given the liberty to extend the finale of the first section according to his own fancy between the two plays without the chords of the following song being generated thereby. If during the playing the word indicated refers to the Start-symbol, the ENR-symbol (end of song), or a not-used, i.e. impossible, word (see FIG. 9), the further handling is as though an END-symbol is concerned.

Figure 8:
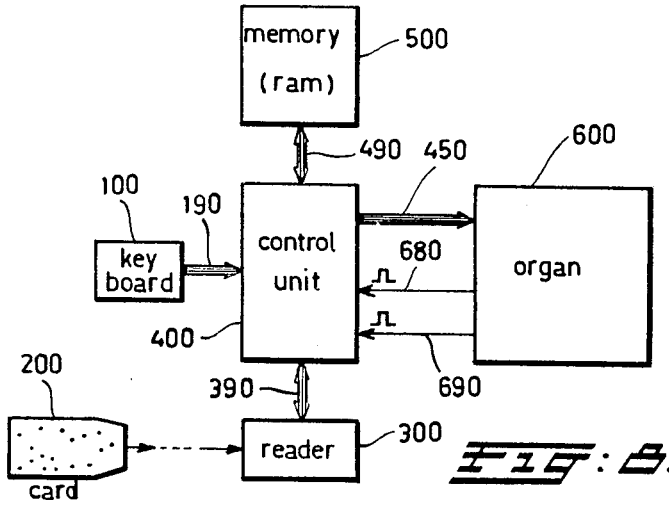
FIG. 8 is a schematic diagram of a third preferred embodiment according to the present invention.
Figure 13:
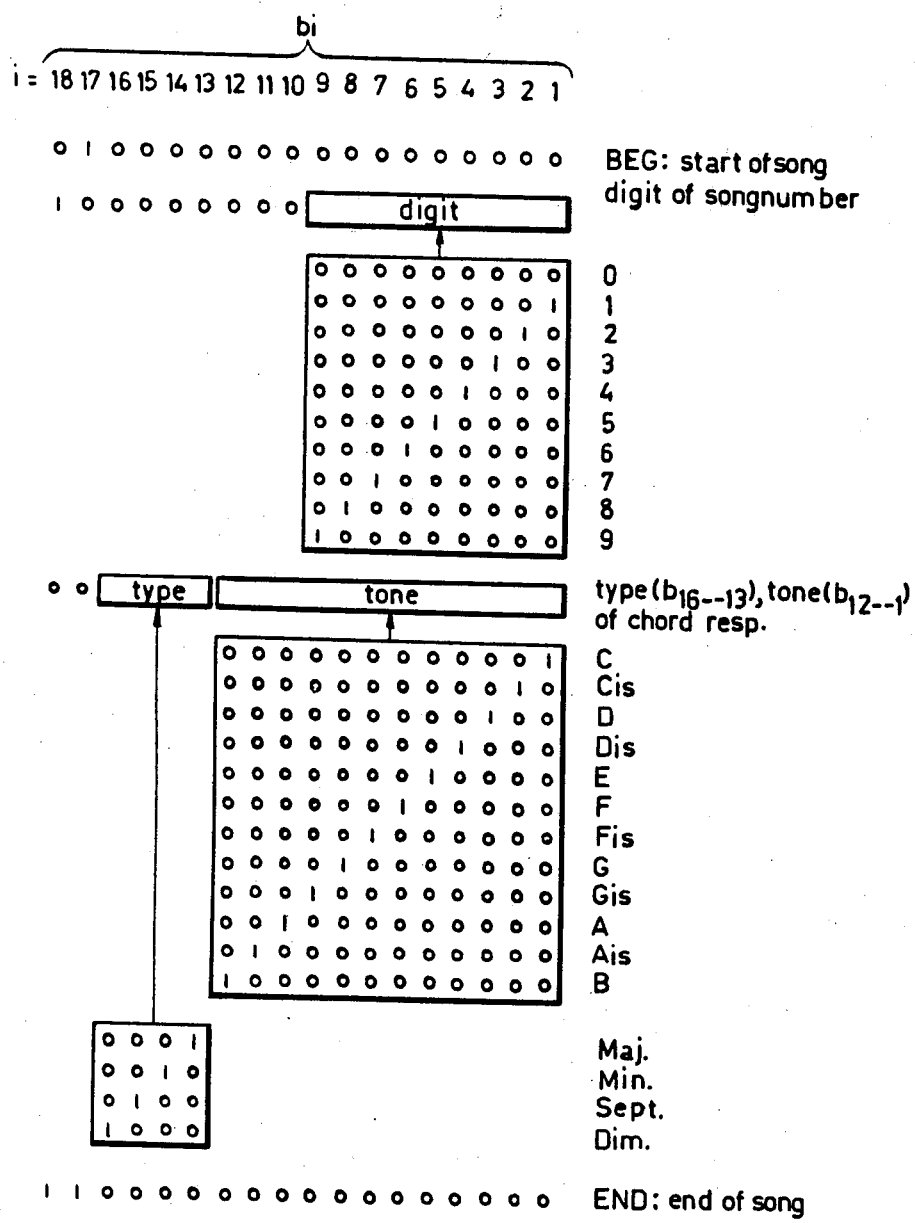
FIG. 13 is a logical diagram belonging to FIG. 11.

If the word read from the memory 500 refers to a chord, it is converted from the code according to FIG. 8 (6 bit) under which it was stored in the memory 500, into the code which can be used by the electronic organ as shown in FIG. 13 (16 bit). Upon receipt of a pulse from the electronic organ 600 via line 680, the respective chord signal is then supplied to the electronic organ 600 and used. After the pulse on line 680 has terminated, the indicator is then increased by one, and the reading of the new memory location, the testing thereon and the supply of the decoded information to the electronic organ 600 is then carried out, and subsequently the indicator is then again increased by one, etc. As long as no pulse is received, it is tested whether a new instruction, such as a instruction, is or has been given with panel 100 via line 190. If this is the case, the playing is ended and the respective activity is undertaken according to the new instruction.

The embodiment of FIG. 8 differs from that of FIG. 7 in that there is no need for certain repetitive portions of a piece of music to reappear in a program card 200 or in the memory 500. Moreover, according to the preferred embodiment of FIG. 8, it is possible to let ranges of chords play programmed ranges of melodies or one of both ranges. Furthermore, as regards ranges of melody-tones, the possibility is included to give one time's rest, to use half tones, to retain a tone till the next time of the following bar and to choose a tone from the tones of four chords.

Figure 15:
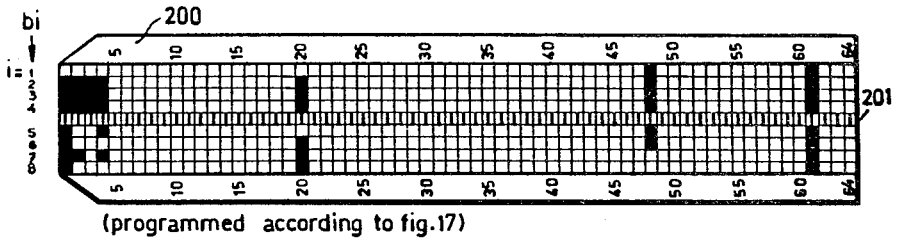
FIGS. 15 and 16 are illustrations of the program cards to be used with the preferred embodiment of FIG. 8.
Figure 17:
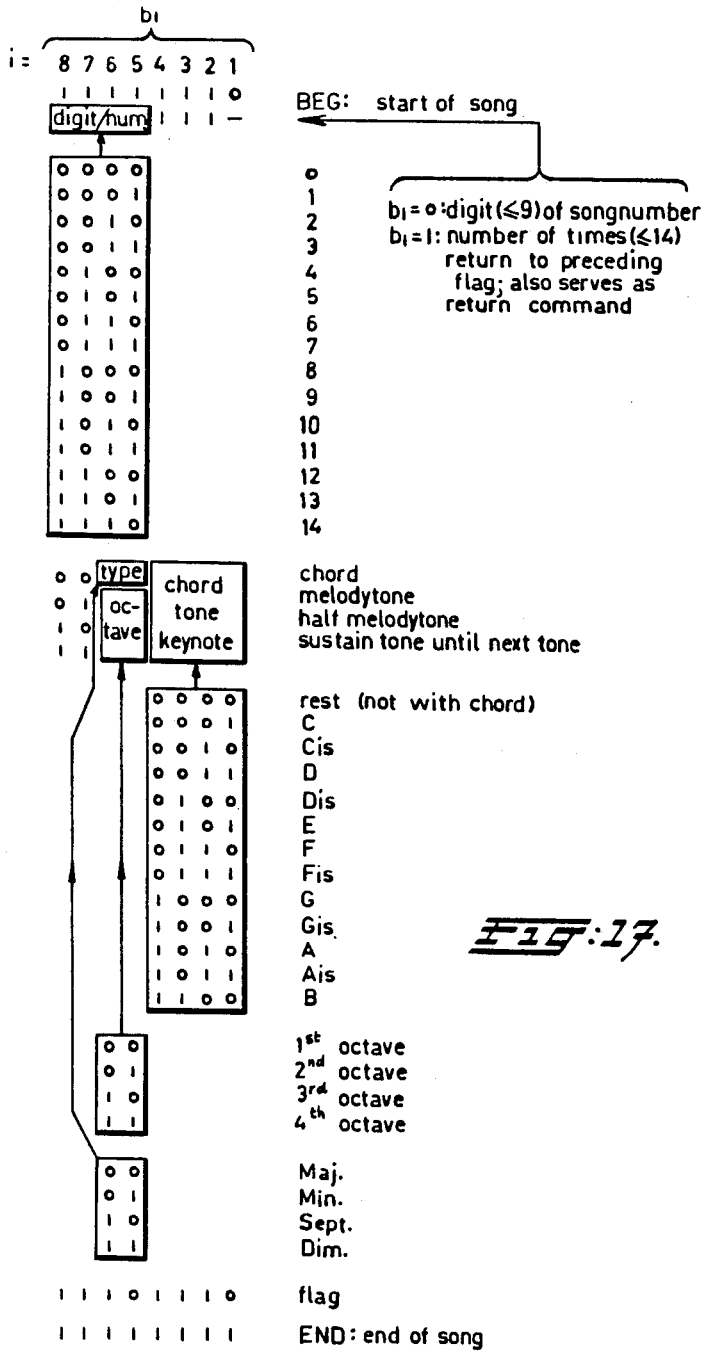
FIG. 17 is a logical diagram belonging to FIG. 15 and refers to the storage in the memory of the embodiment of FIG. 8.
Figure 1B:
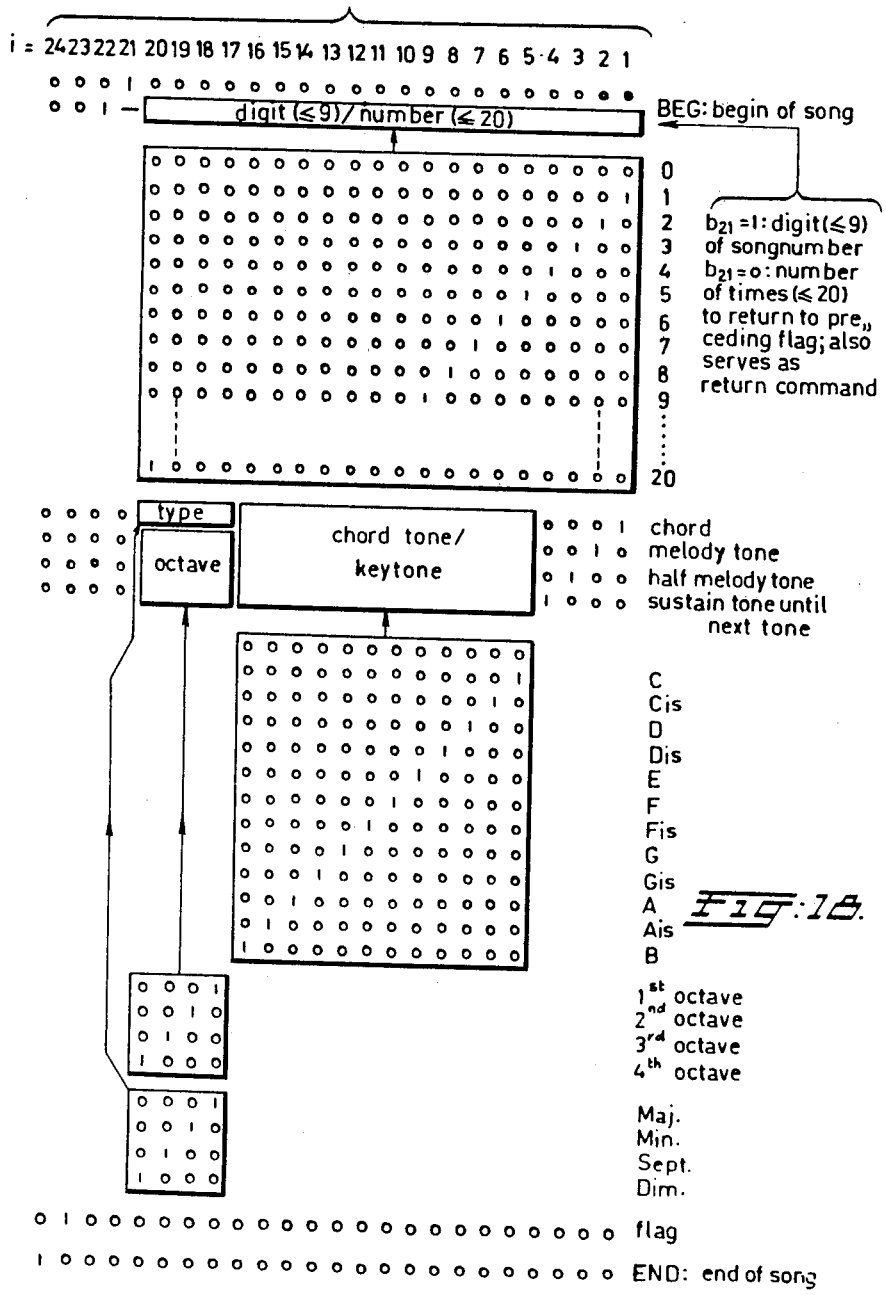

FIG. 15 is a possible program card for the embodiment of FIG. 8 to be coded according to FIG. 17.

Figure 16:
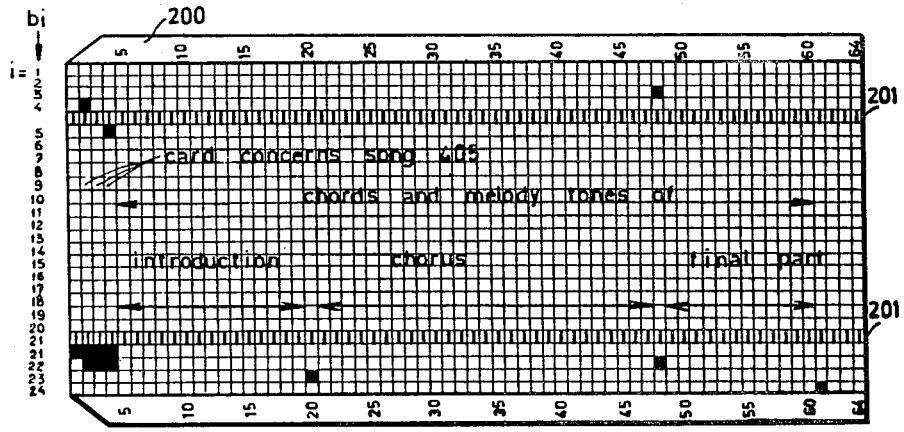

FIG. 16 is a card easy in operation for the user, which is to be programmed in accordance with FIG. 18. The remarks made with regard to the use of the card according to FIG. 11 instead of those according to FIGS. 9 and 10 also apply to the use of the card of FIG. 16, instead of that of FIG. 15.

The code according to FIG. 17 will also be used for the storage in the memory, since the memory is thereby utilized better than when using the code according to FIG. 18 and, with a view to the choice and the price of available components, such as memories and microprocessors, it is desirable to use words of maximum 8 bits.

Figure 19A:
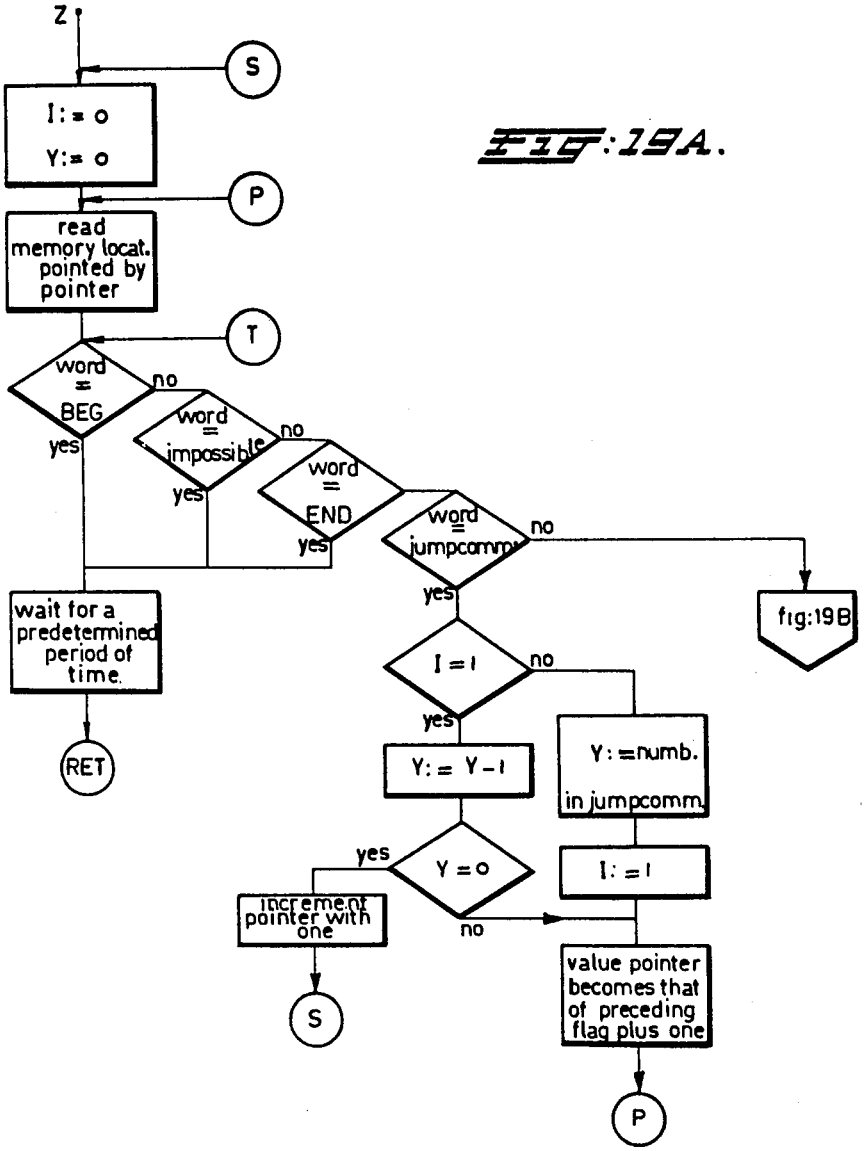
FIGS. 19*a* and 19*b* form in combination a flow chart which explains the working of the preferred embodiment of FIG. 18.
Figure 19B:
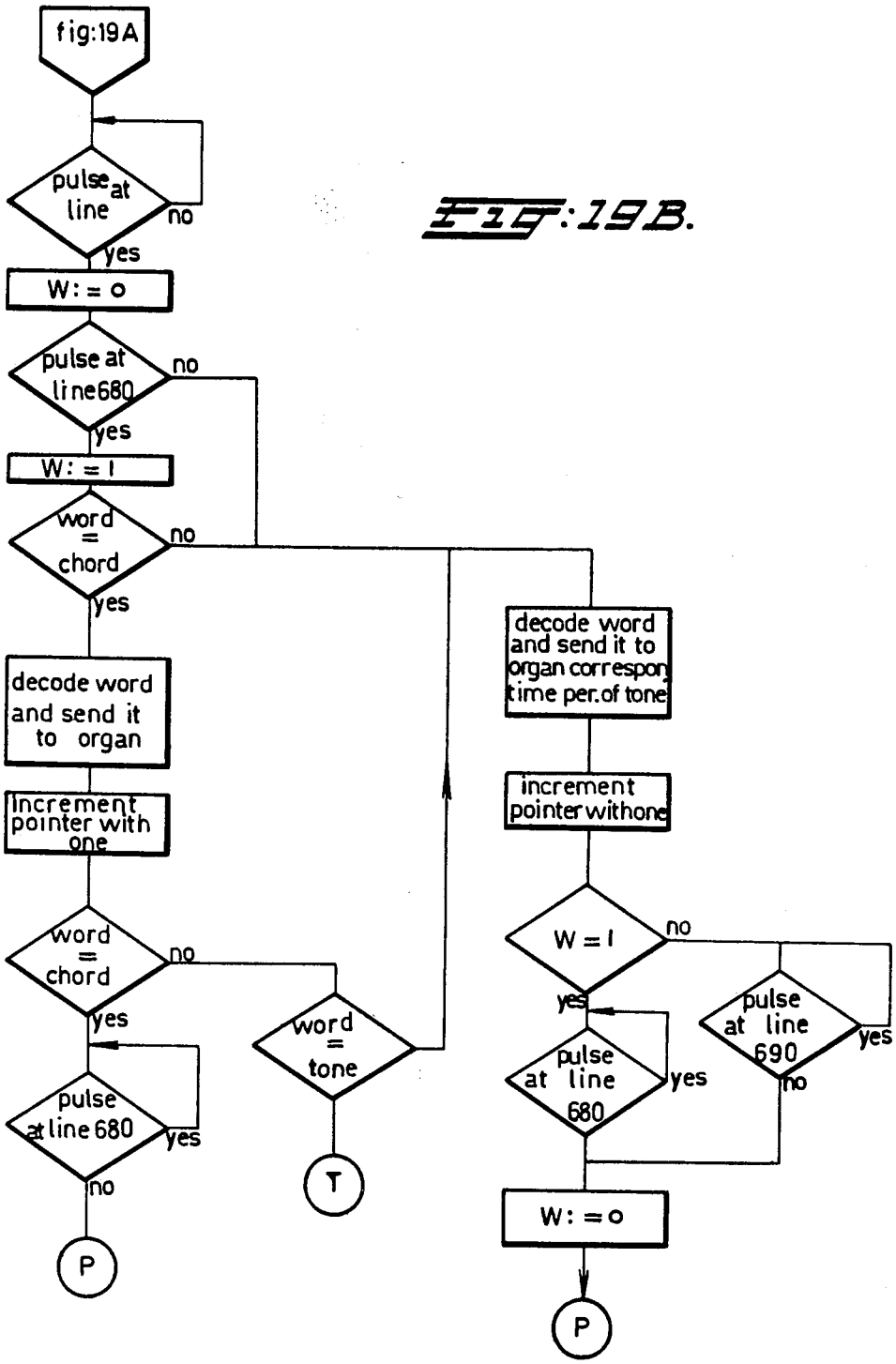

The preferred embodiment according to FIG. 8 will be explained with reference to the flow chart formed by FIGS. 19*a* and 19*b* together. Above the point indicated by the index in FIG. 19*a* will be the same portion as that which is located above the point indicated by index in FIG. 14. For the sake of simplicity in the illustration that portion has been left out in FIG. 19*a*.

Figure 20:
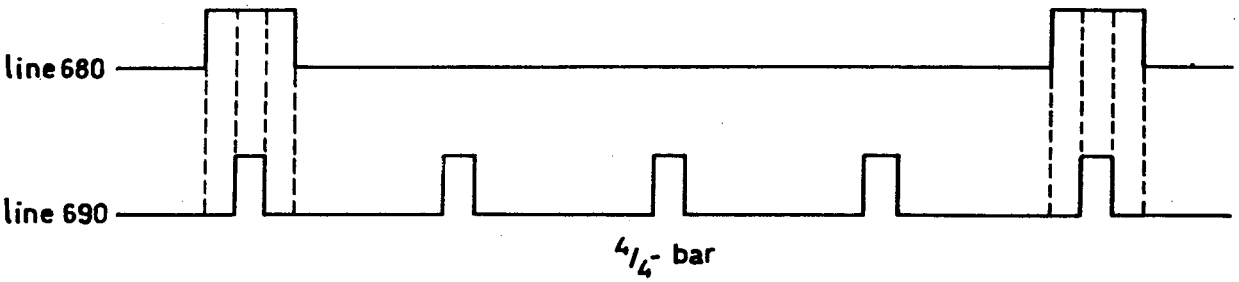
FIG. 20 is a time diagram which shows the train of impacts used in the embodiment of FIGS. 6 to 8.

The starting point is that at each first count of a bar the electronic organ 600 gives a pulse via lines 680 to the control unit 400 for the purpose of generating chords, and moreover, at each count of a bar, supplies a pulse to the control unit 400 via line 690 for the purpose of generating melody tones. The pulses generated by the organ are such or are processed in such a manner that the duration of a pulse on line 680 includes a pulse on line 690. FIG. 20 gives an illustration of the foregoing for a quadruple time.

If during the playing a word read from the memory refers to the START symbol, the END symbol, a cypher of a song number or a codeword not used, i.e. an "impossible" word, the further handling is as though the word refers to an END symbol. In other words, for reasons explained in connection with the embodiment of FIG. 7, a preset time is waited before the next song can be commenced with. If the word refers to a jump ($b_{4\ldots1}=1111$ in FIG. 17), a jump is made to the foregoing flag in the song, provided at least the number of repetitions do not exceed thereby the number indicated in the jump symbol. If there is a pulse on both line 680 and line 690, the two consecutive memory locations are read, the first of which concerns the first chord not yet performed. If the second memory location again concerns a chord, a jump back to the beginning of the procedure (beginning of this paragraph) is made after termination of the pulse on line 680. If the said second memory location concerns a tone then it is supplied at the same time—anyhow apparently for the user—with the chord to the electronic organ 600. After termination of the longest pulse in a count, the beginning of the loop is returned to. If a pulse is received by the control unit 500 via line 690 but if there is no pulse via line 680, the memory location is decoded and supplied to the electronic organ. The output is made to correspond with the programmed demands such as in connection with half and full tones, rest count and holding a tone. For the half duration of a tone, the time between two pulses on line 690 should be measured and divided by two. In an interval between two counts thus found, a half tone may be performed, if desired. The holding of a tone does not last longer than till the output of a following tone. After the longest pulse has passed, the beginning of the loop (i.e. the beginning of this paragraph) is returned to.

It is observed that the present invention may be carried out using discrete gates, flip-flops, counters, etc., for which taking into consideration the large choice of components available, many embodiments are possible. However, in connection with the complexity, the development of heat, the sensitivity to disturbances and the physical size of an embodiment with discrete components, it is, however, advisable to use a microprocessor, taking into consideration the present state of the art.

What is claimed is:

1. In combination a chord performing apparatus, an electronic organ provided with performance keys, a rhythm generating unit and a chord-former having at least one first control input means having first switch elements for providing first control signals for defining a chord tone and at least one second control input means having second switch elements for providing second control signals for defining a chord type, and a rhythm output signal derived from the organ in direct response to depression of performance keys of the organ during the playing of the melody of the music, said chord performing apparatus comprising first and second presettable control means for establishing a predetermined sequential pattern of chords of a selected tone and type corresponding to a sequence of the chords of the music to be played, said first and second presettable control means having scannable outputs adapted to be coupled to the organ, means for scanning said outputs in response to rhythm output signal derived from the organ during the playing of the melody of the music, said outputs being adapted to be coupled to the first and second control input means of the cord-former of the organ for generating chords of selected tone and type in said predetermined sequential pattern.

2. Apparatus according to claim 1 wherein said presettable control means comprises a memory device capable of being stored with information corresponding to chord tones and chord types to be played, readable carrier means for said information, processing means coupled to said memory device for controlling storage of said information, a reader device for reading the carrier means and coupled to said processing means for delivering said information to said memory device and means for reading out said information from said memory device, said last means coupled to the control inputs of the chord-former as control signals by said processing means responsive to the rhythm output signal of the organ in the course of playing same.

3. A chord performing apparatus according to claim 1 wherein said first and second presettable control means comprise plural sets, each of which have an input and an output, the outputs being arranged parallel coupled for each produced chord tone and chord type, said respective parallel outputs being adapted to be connected with the first and second control input means respectively of the chord-former.

4. A chord performing apparatus according to claim 3, wherein said plural sets comprise sets of multiposition switches having corresponding outputs.

5. A chord performing apparatus according to claim 3, wherein said first and second presettable control means include a carrier member and said plural sets comprise sets of conductor matrixes arranged on said carrier member and including intersecting input conductors and output conductors, the said conductors capable of being interconnected at the intersections thereof.

6. A chord performing apparatus according to claim 5 in which said interconnections include permanently mounted connections.

7. A chord performing apparatus according to claim 5, in which said interconnections comprise connecting plug pins at the intersections.

8. A chord performing apparatus according to claim 1, and a reading device, said presettable control means include a preprogrammed information carrier, said carrier capable of being processed by said reading device in response to said rhythm output signal.

9. A chord performing apparatus according to claim 8, wherein said information carrier is an optically readable device and said reading device includes an optical reader.

10. A chord performing apparatus according to claim 9, wherein said information carrier includes a punch-card.

11. A chord performing apparatus according to claim 8, wherein said information carrier includes magnetizable portions and being programmable magnetically.

12. A chord performing apparatus according to claim 8, wherein the information carrier includes electrically conducting portions and being programmable with said electrically conducting portions.

13. A chord performing apparatus according to claim 8, wherein said control input means of said chord-former correspond to sets of positions, said sets being indicated in binary coded form, a decoding device, said reading device providing readout information for controlling said decoding device and said decoding device comprising a binary converter connected for feeding said readout information in a condition for direct processing by said chord-former.

14. A chord performing apparatus according to claim 8 and a memory device, said reading device having outputs connected to said memory device for recording the information carried by said carrier and said memory device being readable for controlling the organ for generating chords of selected tone and type in said predetermined sequential pattern in response to said rhythm output signal of the organ.

* * * * *